United States Patent [19]

Oguro

[11] Patent Number: 5,003,223

[45] **Date of Patent: * Mar. 26, 1991**

[54] STRUCTURE OF ANODE OF MAGNETRON AND A METHOD OF MANUFACTURING THE SAME

[75] Inventor: Tomokatsu Oguro, Mobara, Japan

[73] Assignee: Hitachi, Ltd., Tokyo, Japan

[ * ] Notice: The portion of the term of this patent subsequent to Aug. 29, 2006 has been disclaimed.

[21] Appl. No.: 334,135

[22] Filed: Apr. 6, 1989

Related U.S. Application Data

[63] Continuation of Ser. No. 86,933, Aug. 19, 1987.

[51] Int. Cl.[5] ..... H01J 25/587

[52] U.S. Cl. ..... 315/39.75; 315/39.51; 445/35; 445/66

[58] Field of Search ..... 315/39.51, 39.63, 39.69, 315/39.75, 39.77; 445/35, 66

[56] References Cited

U.S. PATENT DOCUMENTS 3,678,575 7/1972 Akeyama et al. ..... 315/39.51

4,295,595 10/1981 Imai et al. ..... 445/35

FOREIGN PATENT DOCUMENTS 4858764 8/1971 Japan .

5224070 9/1975 Japan .

56-162850 12/1981 Japan .

*Primary Examiner*—Eugene R. Laroche

*Assistant Examiner*—Michael B. Shingleton

*Attorney, Agent, or Firm*—Antonelli, Terry, Stout & Kraus

[57] ABSTRACT

The invention relates to a structure of an anode of a magnetron and to a method of manufacturing the same. This structure has a cylindrical outer frame portion and a plurality of vanes which are integrally formed with the outer frame portion and which radially extend from the inside of the outer frame portion in the central direction of the cylindrical outer frame portion. Projecting portions of predetermined shapes are formed on the inner wall of the outer frame portion or on the vanes so as to be integrated with the outer frame portion or vanes.

8 Claims, 3 Drawing Sheets

STRUCTURE OF ANODE OF MAGNETRON AND A METHOD OF MANUFACTURING THE SAME

This is a continuation application of U.S. Ser. No. 086,933, filed Aug. 19, 1987.

BACKGROUND OF THE INVENTION

The present invention relates to a structure of an anode of a magnetron suitable for use in a microwave heating apparatus and to a method of manufacturing a magnetron having this structure.

A method of manufacturing the anode of a magnetron by a hobbing working method has been disclosed in U.S. Pat. No. 3,678,575 (invented by Akeyama et al) filed on July 25, 1972 which is assigned to the same assignee of the present invention. This method includes the process of removing the remaining portion by the cutting work after the hobbing work.

In the anode of a magnetron, a plurality of vanes constituting a resonator are formed in the inside of a cylindrical outer frame. Methods for adhering the to vanes the outer frame by soldering has are known. There is a problem in such methods in that in mass production a large amount of expensive silver solder is needed, the soldering process is necessary and the like. Therefore, it is desirable to simultaneously integrally manufacture the outer frame and the vanes by hobbing working a material.

As another anode structure and a method of manufacturing the same, for example, there is known an anode with such a structure that after an anode was divided into two parts and manufactured, both of them are adhered by soldering as disclosed in JP-A 48-58764 on the basis on the invention applied to Japanese Patent Office by Hitachi, Ltd. on Aug. 17, 1971. In addition, a method of manufacturing an anode by the hobbing working has been disclosed in JP-A 52-24070 based on the invention applied to Japanese Patent Office by Toshiba Corporation on Aug. 19, 1975. According to this method, a disk-shaped portion is left in the central portion of a cylinder, vanes are formed integrally with the cylindrical outer frame by hobbing, and the remaining disk-shaped portion is finally struck by pressing.

The fundamental oscillating frequency of the magnetron for microwave heating is strictly regulated by the law and it is required that unnecessary spurious radiation be prevented. Therefore, high dimensional accuracy of the anode as a resonator is required. To meet this requirement, copper, in particular, oxygen-free copper is generally used as a material of the anode since it is a non-magnetic material and it is easy to work. Although copper can be easily worked, it is weak and easily deformed by a mechanical stress. For example, although the anode is used with radiator fins for cooling arranged to the outside of the anode, when the fins are pressure inserted into the outside of the anode, the anode is deformed, creating the possibility that the oscillating frequency, operating voltage, and efficiency may deviate from the desired design values. Also, unnecessary harmonic components are generated and radiated due to the deformation. Further, while the magnetron is being used, the temperature of the central portion of the anode becomes high but the temperature of the outside of the anode is low because it is cooled, causing the anode to be subjected to a thermal stress which causes deformation. Such a deformation causes deformation of a strap ring which is used for adjusting the oscillating frequency of the magnetron upon manufacturing. In the worst case, the function of the anode is lost.

Therefore, it is desirable that the anode of the magnetron have a structure which is suitable for mass production which does not include the soldering and cutting works and also has an excellent mechanical strength.

SUMMARY OF THE INVENTION

It is an object of the present invention to provide an anode structure which is easily mass produced and has high mechanical strength and to provide a method of manufacturing an anode with such a structure.

Another object of the invention is to provide an anode structure which outputs less spurious radiation than conventional anode structures and to provide a method of manufacturing an anode with such a structure.

Still another object of the invention is to provide an anode structure in which the oscillating frequency of the anode upon manufacturing can be adjusted by another portion as well as a strap ring and to provide a method of manufacturing an anode with such a structure.

According to a novel structure of the invention to accomplish the above object, a cylindrical outer frame portion and vanes have an integrated structure and a projecting portion formed in a part of the integrated structure between adjacent vanes. Also a method of manufacturing the novel anode according to the invention provides in the process to form the vanes by hobbing working a base material, a projecting portion is formed in a part of the integrated structure of the vanes and outer frame portion.

DESCRIPTION OF THE PREFERRED EMBODIMENTS

Figure 1:
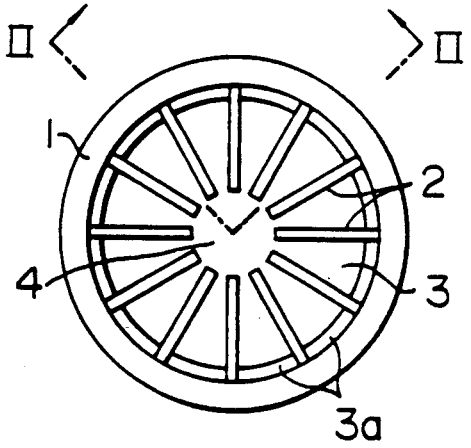
FIG. 1 is a plan view of a first embodiment of an anode according to the present invention.
Figure 2:
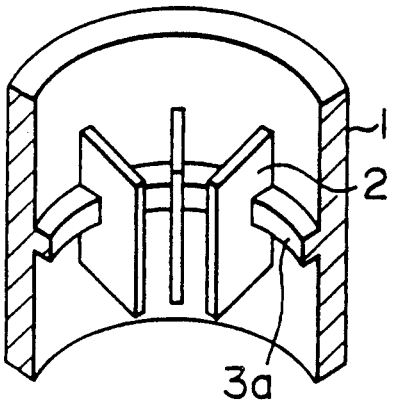
FIG. 2 is a cross sectional view taken along the line II—II in FIG. 1.

FIG. 1 is a plan view showing the first embodiment of an anode of a magnetron according to the present invention. Reference numeral 1 denotes a cylindrical outer frame portion constituting the anode; 2 indicates vanes which are radially projected from the inside of the outer frame portion 1 toward the central portion thereof; 3 a resonator cavity portion which is formed by adjacent two vanes; 3a projecting portions to give mechanical strength to the outer frame portion 1 and vanes 2; and 4 an oscillating interaction space of the central portion of the anode. A cathode (not shown) is arranged in the space 4. FIG. 2 is a cross sectional view taken along the line II—II in FIG. 1. The projecting portions 3a are substantially vertically projected from the inner wall of the cylindrical outer frame portion 1 and connect the vanes 2 with one another. The projecting dimensions and thickness from the inner wall of the projecting portion 3a are determined in consideration of the shapes and dimensions of the vanes 2 since they exert an influence on the resonance characteristics. Since the projecting portions 3a reinforce the outer frame portion 1, when radiator fins for cooling are pressure inserted into the outside of the outer frame portion 1 in the assembling step of the magnetron, the anode is not deformed. Therefore, the magnetron having an accurate oscillating frequency and a high reliability is obtained. Further, since the anode is not deformed, a contact property between the radiator fins and the outer frame portion 1 is good and a high cooling effect is derived thereby permitting stable operation.

Figure 3A:
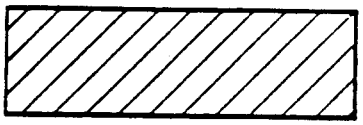
FIGS. 3A to 3D are cross sectional views for explaining manufacturing steps of the anode in FIG. 1.
Figure 3B:
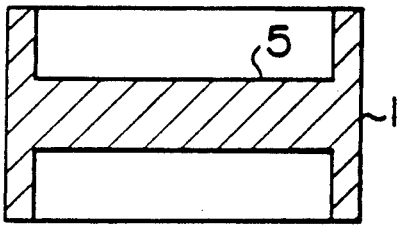
Figure 3C:
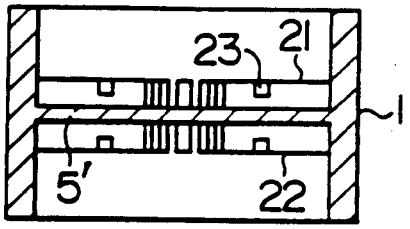
Figure 3D:
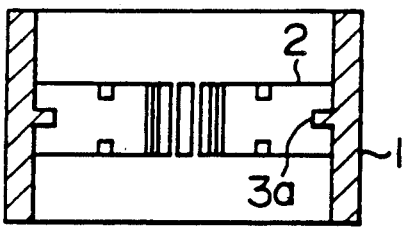

FIGS. 3A to 3D are cross sectional views for explaining the manufacturing processes of the anode shown in FIGS. 1 and 2. A cylindrical copper billet of FIG. 3A is molded by the first pressing step so as to obtain an H-shaped cross section as shown in FIG. 3B. The cylindrical outer frame portion 1 and a disk-shaped portion 5 are formed in the almost central portion. FIG. 3C shows the second pressing step. By hobbing pressing the disk-shaped portion 5, vane portions 21 and 22 serving as the vanes 2 in FIG. 1 are formed. In FIG. 3C, a groove-shaped recess 23 formed in the vane portions is used to fix a strap ring and is formed simultaneously with the vane portion 21 at the time of the hob pressing step. In the step of FIG. 3C, a disk-shaped portion 5' remains as a thin plate. Therefore, the remaining thin disk-shaped portion 5' is removed to provide the resonator cavity portion 3 and oscillating interaction space 4 as seen in FIG. 1. FIG. 3D shows this removal step. Namely, the workpiece of FIG. 3C is put on a female mold having a vane shape. A male mold having a vane shape is further pressed onto the workpiece and the disk-shaped portion 5' is struck such that the projecting portion 3a is left. The details will be explained hereinafter with reference to FIGS. 9 to 11.

Figure 4A:
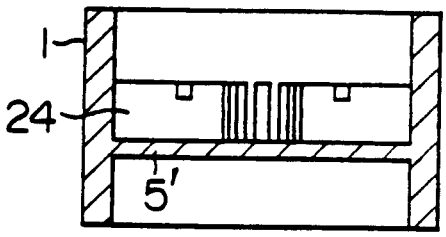
FIGS. 4A and 4B show cross sectional views for explaining a structure of the second embodiment of an anode of the invention and manufacturing steps of this anode.
Figure 4B:
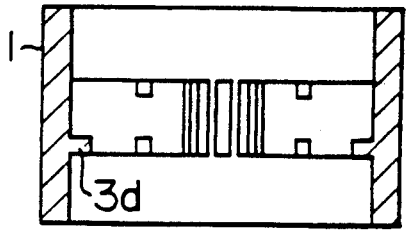

FIGS. 4A and 4B are cross sectional views showing another embodiment. A plan view of this embodiment is the same as FIG. 1. This embodiment differs from that shown in FIGS. 3C and 3D with respect to the point that in the hobbing pressing step, the disk-shaped portion 5' is not left in the central portion of the vane but is left at one end thereof as shown in FIG. 4A. Therefore, by striking the disk-shaped portion 5' with the projecting portion 3d left, the projecting portion 3d is formed in the end portion of the vane as shown in FIG. 4B. This embodiment has an advantage such that the manufacturing steps are simplified and easily mass produced is derived.

Figure 5:
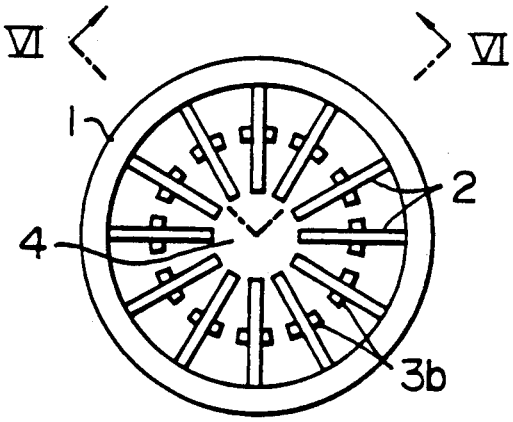
FIG. 5 shows a plan view of the third embodiment of an anode of the invention.
Figure 6:
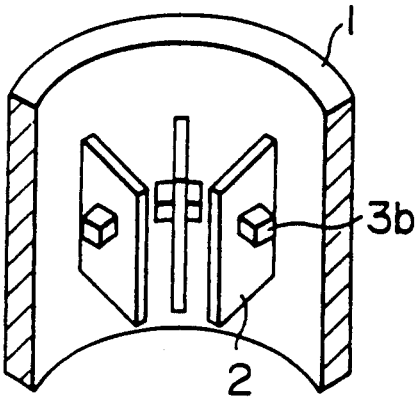
FIG. 6 is a cross sectional view taken along the line VI—VI in FIG. 5.

FIG. 5 shows still another embodiment of an anode of the invention. In this embodiment, when the disk-shaped portion 5 is struck, projecting portions 3b are formed on the almost central surfaces of the vanes themselves. In this structure, the projecting portions 3b themselves function as inductances and the gap between the opposite projecting portions 3b forms an electrostatic capacitance. By properly setting their dimensions, a voltage distribution to the vanes is changed for a specific harmonic mode and unnecessary harmonics which are propagated through an antenna (not shown) to the outside can be remarkably reduced. The position of the vane at which the projecting portion 3b is left is also a significant parameter and this position can be set due to the harmonics to be reduced. The dimensions of the projecting portions 3b of all vanes are not limited to the same values. For example, the long and short projecting portions can be alternately formed. FIG. 6 is a cross sectional view taken along the line VI—VI in FIG. 5.

Figure 7:
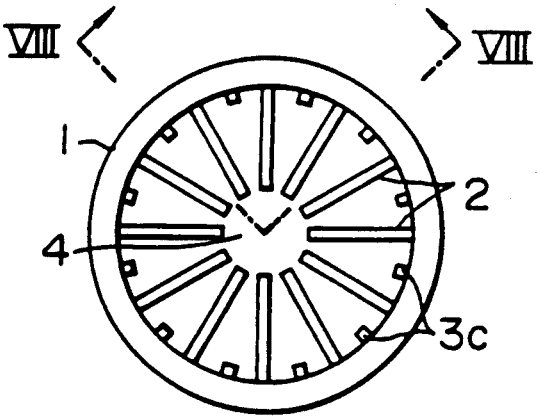
FIG. 7 shows a plan view of the fourth embodiment according to the invention.
Figure 8:
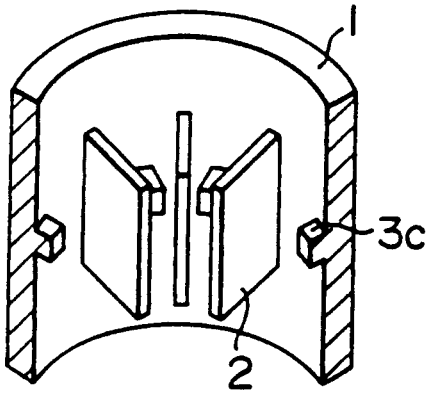
FIG. 8 shows a cross sectional view taken along the line VIII—VIII in FIG. 7.

FIG. 7 shows still another embodiment of the invention. Very small projecting portions 3c are left near the cylindrical portion. The projecting portions 3c function to raise the fundamental oscillating frequency. The resonance frequency can be adjusted by changing the dimensions of the projecting portions 3c by bending or cutting them. Namely, after the projecting portion 3c is formed, it is slightly modified and the resonance frequency can be finely adjusted to a desired value. Therefore, a magnetron having less frequency dispersion and the higher reliability can be obtained as compared with a conventional fine adjusting method by only the modification of a strap ring (not shown). FIG. 8 is a cross sectional view taken along the line VIII—VIII in FIG. 7.

Figure 10:
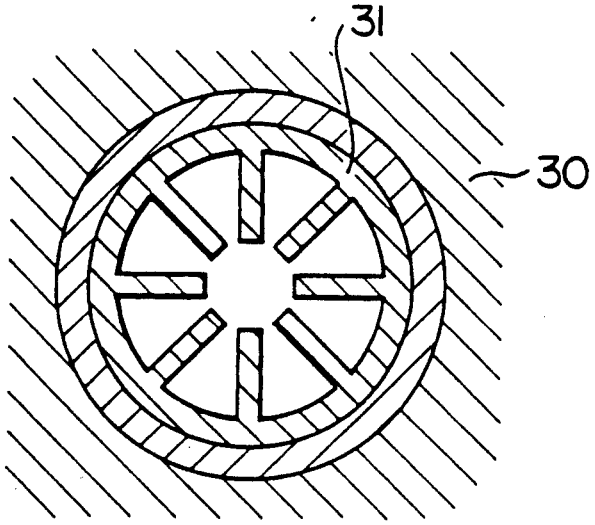
FIG. 10 is a partial cross sectional view of a fixing mold which is used in the striking process.
Figure 11:
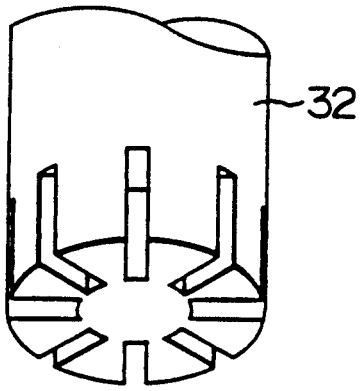
FIG. 11 is an external view of a male mold which is used in the striking process.

An example of a practical method of manufacturing an anode formed with projecting portions 3d in FIG. 4B from the workpiece in FIG. 4A will now be explained with reference to FIGS. 9 to 11.

Figure 9:
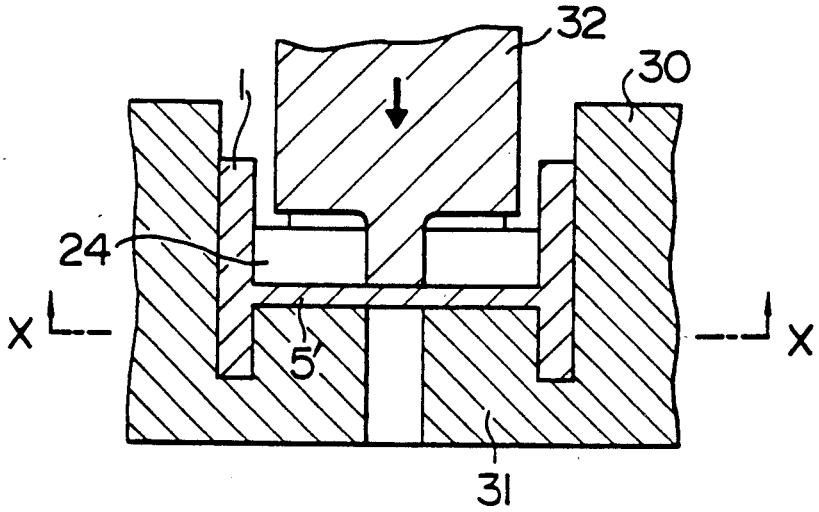
FIG. 9 is a cross sectional view showing a striking process.

A workpiece formed with a vane portion 24 and the disk-shaped portion 5' by the hobbing pressing step is buried into a fixing mold 30 as shown in FIG. 9. A cross sectional shape taken along the line X—X of the fixing mold 30 is as illustrated in FIG. 10. As shown in FIG. 10, a bottom portion 31 of the fixing mold constitutes a female mold to strike the disk-shaped portion other than the vane portion and the projecting portion. A male mold 32 as shown in FIG. 11 is positioned over the female mold 31 through the workpiece and is pressed from over the workpiece in the direction indicated by an arrow in FIG. 9. Thus, a disk-shaped portion is struck with the projecting portion 3d as seen in FIG. 4B left. According to this method, since only the male mold 32 is the movable member, there are advantages such that the mechanism is simple, the positioning work is easy, the finished surface of the struck portion is smooth, and a high mass productivity is derived.

This method can be also applied to any embodiments shown in FIGS. 3D, 5, and 7 by merely changing a pressing mold.

What is claimed is:

1. An anode of a magnetron comprising:

a cylindrical outer frame portion;

a plurality of vanes radially extending from inside of said outer frame portion in a central direction thereof to have an integrated structure with the outer frame portion; and a continuous annular projecting portion formed between adjacent vanes to be integrally formed on the inside surface of said integrated structure of the outer frame portion and having a width in a direction perpendicular to said central direction smaller than a corresponding width of said vanes thereby avoiding a substantial change in oscillation frequency of the magnetron;

wherein said projecting portion is integrally formed at an end portion of said vanes, said end portion being at an end of said vanes in a direction parallel to an axial direction of said outer frame portion, said projecting portion being integrally formed on the inside surface of the outer frame portion and being integrated with said vanes.

2. An anode of a magnetron comprising:

a cylindrical outer frame portion;

a plurality of vanes radially extending from an inside surface of said outer frame portion in a central direction thereof to have an integrated structure with the outer frame portion;

projecting portions being respectively formed on said vanes at halfway portions in the central direction of the outer frame portion of said vanes to be integrated with said vanes.

3. An anode of a magnetron comprising:

a cylindrical outer frame portion;

a plurality of vanes radially extending from an inside surface of said outer frame portion in a central direction thereof to have an integrated structure with the outer frame portion; and projecting portions formed on said inside surface of said outer frame portion, said projecting portions being respectively positioned on portions of said inside surface halfway between said vanes to be integrated with the outer frame portion.

4. A method of integrally manufacturing a magnetron anode from a single base material, said magnetron being constituted by a cylindrical outer frame portion, a plurality of vanes which extend from inside of said outer frame portion in a central direction thereof, and projecting portions which are formed on said vanes or inside of the outer frame portion, said method comprising the steps of:

pressing a single cylindrical electro-conductive base material in an axial direction thereof, and forming a disk-shaped portion at an almost central portion in an axial direction of said cylindrical outer frame portion in the inside of the outer frame portion;

hobbing pressing said disk-shaped portion forming a cylindrical outer frame portion and a thinner disk-shaped portion inside of said cylindrical outer frame portion, and forming a plurality of vanes on at least one surface said thinner disk-shaped portion, said vanes having end portions and radially extending from the inside of the outer frame portion toward the central portion thereof; and striking the portion other than portions of said thinner disk-shaped portion integral with said plurality of vanes in a manner such that predetermined projecting portions are formed on said vanes or inside of the outer frame portion.

5. A method according to claim 4, wherein in the step of forming said vanes, said thinner disk-shaped portion is left in one end portion in the actual direction of said outer frame portion of said disk-shaped portion, and said plurality of vanes are formed on one surface of said thinner disk-shaped portion.

6. A method according to claim 4, wherein in the step of striking, the projecting portions formed on an inner wall of said outer frame portion between said vanes to be integrated with said vanes are left, and said thinner disk-shaped portion is struck.

7. A method according to claim 4, wherein in the step of striking, said thinner disk-shaped portion is struck to leave the projecting portions formed at positions away from an inner wall of said outer frame portion of said vanes.

8. A method according to claim 4, wherein in the step of striking, said thinner disk-shaped portion is struck to leave the projecting portions formed on an inner wall of said outer frame portion at positions away from said vanes.

* * * * *